US006550088B1

(12) United States Patent
Chang

(10) Patent No.: US 6,550,088 B1
(45) Date of Patent: Apr. 22, 2003

(54) ADJUSTABLE SHOE TREE HAVING MICRO-ADJUSTING STRUCTURE

(76) Inventor: Chen Te Chang, No. 78, Su Yi 5th Lane, South Dist., Taichung 402 (TW)

( * ) Notice: Subject to any disclaimer, the term of this patent is extended or adjusted under 35 U.S.C. 154(b) by 0 days.

(21) Appl. No.: 09/943,297

(22) Filed: Aug. 31, 2001

(51) Int. Cl.[7] ..... A43D 15/00
(52) U.S. Cl. ..... 12/114.2; 12/115.6; 12/115.8
(58) Field of Search ..... 12/114.2, 114.6, 12/115.6, 115.8, 116.2, 116.6, 117.4, 124

(56) References Cited

U.S. PATENT DOCUMENTS 1,467,915 A * 9/1923 Ballard ..... 12/117.4
1,469,238 A * 10/1923 Newlin ..... 12/117.4
1,483,065 A * 2/1924 Anderson ..... 12/116.2
1,778,594 A * 10/1930 Hansen ..... 12/116.2
2,255,471 A * 9/1941 Mutch ..... 12/115.8
2,340,404 A * 2/1944 Mutch ..... 12/116.2
2,357,687 A * 9/1944 Reinhardt ..... 12/115.6
2,473,176 A * 6/1949 Schoshusen ..... 12/115.8
2,690,575 A * 10/1954 Vaillancourt ..... 12/115.6
2,811,731 A * 11/1957 De Witt ..... 12/115.6
2,903,725 A * 9/1959 Zeserson et al.
3,263,252 A * 8/1966 Johnson ..... 12/116.6
3,512,199 A * 5/1970 Messinger ..... 12/117.4

* cited by examiner

*Primary Examiner*—M. D. Patterson
(74) *Attorney, Agent, or Firm*—Charles E. Baxley

(57) ABSTRACT

A shoe tree includes a toe member, a heel member, a spacer bar having a front portion quickly or micro-adjustably secured to the toe member and having a rear portion biased to engage with the heel member, such that the heel member and the toe member may be adjustably and accurately engaged into the shoes of different sizes or lengths. The toe member has two flanges each having a number of depressions. A latch is secured to the spacer bar and has two arms, and a pawl may force the arms to engage with the depressions of the flanges of the toe member.

12 Claims, 15 Drawing Sheets

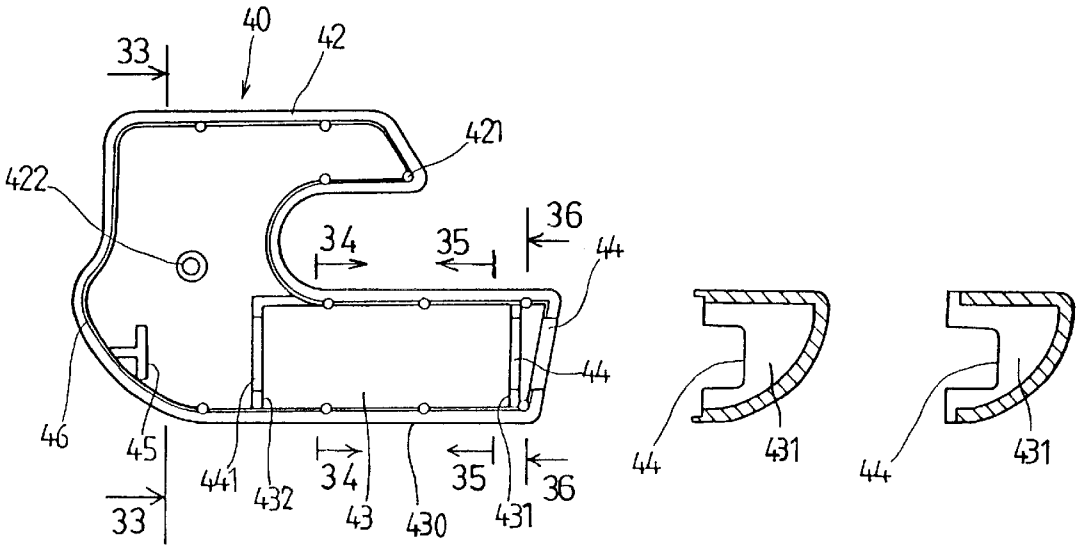
FIG. 32
FIG. 35 FIG. 36
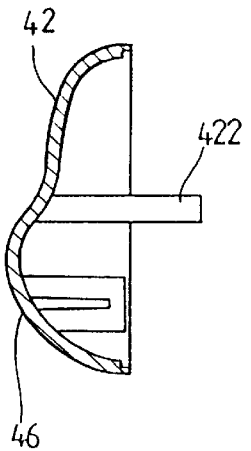
FIG. 33 FIG. 34

ADJUSTABLE SHOE TREE HAVING MICRO-ADJUSTING STRUCTURE

BACKGROUND OF THE INVENTION

1. Field of the Invention

The present invention relates to a shoe tree, and more particularly to a shoe tree having a micro-adjusting mechanism or structure.

2. Description of the Prior Art

Typical adjustable shoe trees comprise a toe member for engaging into the front portion of the shoe, a heel member for engaging in the rear portion of the shoe, and a spacer bar adjustably secured between the toe member and the heel member. The spacer bar and the toe member, or the spacer bar and the heel member are normally adjustably secured together with an engagement of a projection with either of a number of cavities, or with an engagement between teeth. However, once the projection is engaged with a selected cavity, or once the teeth are engaged with each other, the shoe tree should be forced into the shoe, and may not be easily engaged into the shoe.

The other typical adjustable shoe trees comprise a toe member for engaging into the front portion of the shoe, a heel member for engaging in the rear portion of the shoe, a spacer bar slidably engaged between the toe member and the heel member, and a spring member engaged between the spacer bar and the toe member, or engaged between the spacer bar and the heel member, for forcing the toe member and the heel member to engage with the shoe. However, the spring may not suitably force the toe member and the heel member to solidly engage with the shoe when the shoe includes a length greater than a predetermined length. Relatively, the shoe tree may not be suitably engaged into the shoe when the shoe includes a length shorter than a predetermined length, even when the spring has been completely compressed to the most compact configuration.

The present invention has arisen to mitigate and/or obviate the afore-described disadvantages of the conventional adjustable shoe trees.

SUMMARY OF THE INVENTION

The primary objective of the present invention is to provide an adjustable shoe tree including a micro-adjusting mechanism or structure for allowing the shoe tree to be suitably adjusted relative to various kinds of shoes that have different lengths or different inner volumes.

In accordance with one aspect of the invention, there is provided a shoe tree comprising a toe member for engaging with a front portion of a shoe, a heel member for engaging with a rear portion of a shoe, a spacer bar including a front portion for engaging with the toe member and a rear portion for engaging with the heel member, means for adjustably securing the front portion of the spacer bar to the toe member, and means for biasing the heel member away from the spacer bar to engage with the rear portion of the shoe. The spacer bar may be quickly or micro-adjusted relative to the toe member with the adjustably securing means. In addition, the biasing means may bias the heel member and the spacer bar, or the heel member and the toe member away from each other, such that the heel member may further be biased and moved relative to the spacer bar for allowing the toe member and the heel member to be adjustable and accurately engaged into the shoes of different sizes or lengths.

The adjustably securing means includes a lock device for adjustably securing the front portion of the spacer bar to the toe member, The lock device includes one or two flanges provided in the toe member and each having a plurality of depressions formed therein, a latch secured to the front portion of the spacer bar and having one or two arms, and means for forcing the arms to engage with the flanges of the toe member.

The forcing means includes a pawl slidably secured to the latch and having a protrusion for engaging with the arms and for forcing the arms to engage with the flanges of the toe member.

The arms each includes a tongue for engaging with the depressions of the flanges respectively, the pawl is movable between the tongues for forcing the tongues to engage with the depressions of the flanges respectively.

A device is further provided for retaining the pawl to the latch and includes at least one cavity in the latch, and at least one leg extended from the pawl and having a projection for engaging with the cavity of the latch.

The heel member includes a conduit formed therein for slidably receiving the rear portion of the spacer bar, the biasing means includes a spring engaged between the spacer bar and the heel member for biasing the heel member away from the spacer bar.

The spacer bar includes a stop provided thereon and slidably received in the conduit of the heel member, the spring is engaged between the stop and the heel member.

The heel member includes an anvil provided therein for engaging with the spacer bar and for limiting a sliding movement of the spacer bar relative to the heel member.

The spacer bar includes a middle portion having a non-circular cross section, and includes a rear portion having a circular cross section, the heel member includes a conduit formed therein and defined by at least one first partition and at least one second partition, the first partition includes a non-circular orifice formed therein for slidably receiving the non-circular middle portion of the spacer bar, and the second partition includes a circular orifice formed therein for slidably receiving the circular rear portion of the spacer bar.

Further objectives and advantages of the present invention will become apparent from a careful reading of a detailed description provided hereinbelow, with appropriate reference to accompanying drawings.

BRIEF DESCRIPTION OF THE DRAWINGS

FIG. 32 is a rear schematic view of the other side casing of the heel member of the shoe tree;

FIGS. 33, 34, 35, 36 are cross sectional views taken along lines 33—33, 34—34, 35—35, and 36—36 of FIG. 32 respectively;

DETAILED DESCRIPTION OF THE PREFERRED EMBODIMENT

Figure 1:
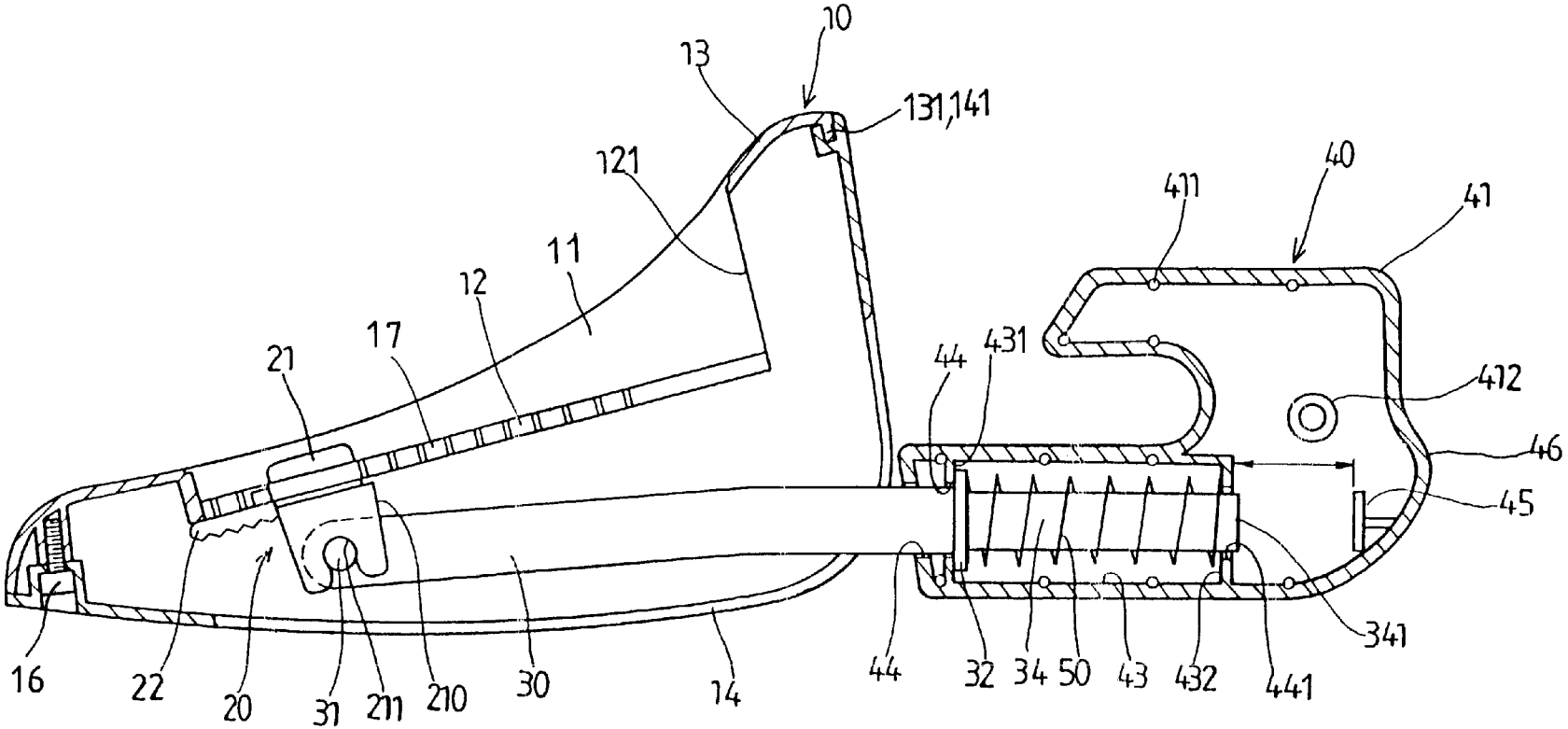
FIG. 1 is a cross sectional view of a shoe tree in accordance with the present invention.
Figure 2:
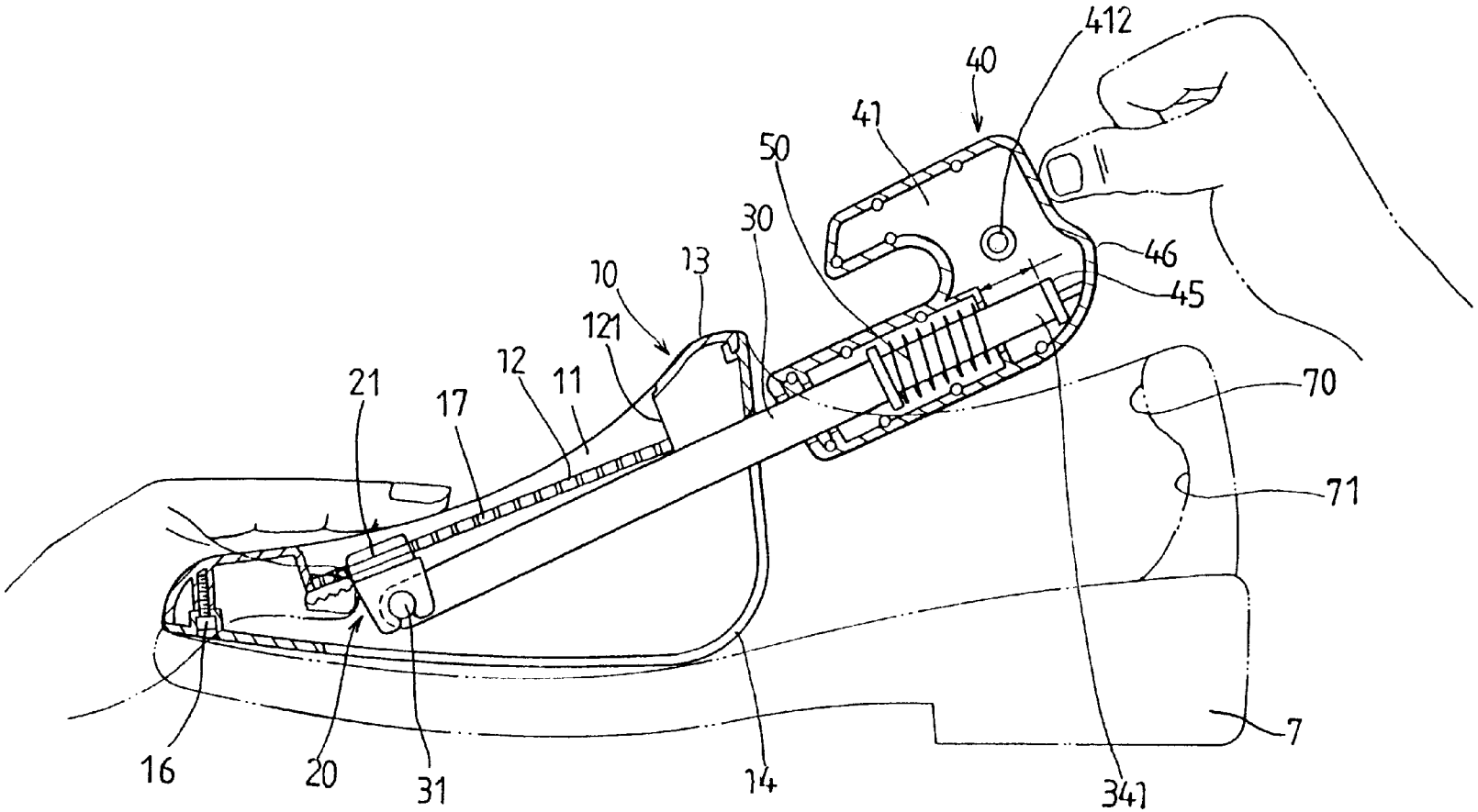
FIGS. 2, 3 are cross sectional views similar to FIG. 1, illustrating the operation of the shoe tree.
Figure 3:
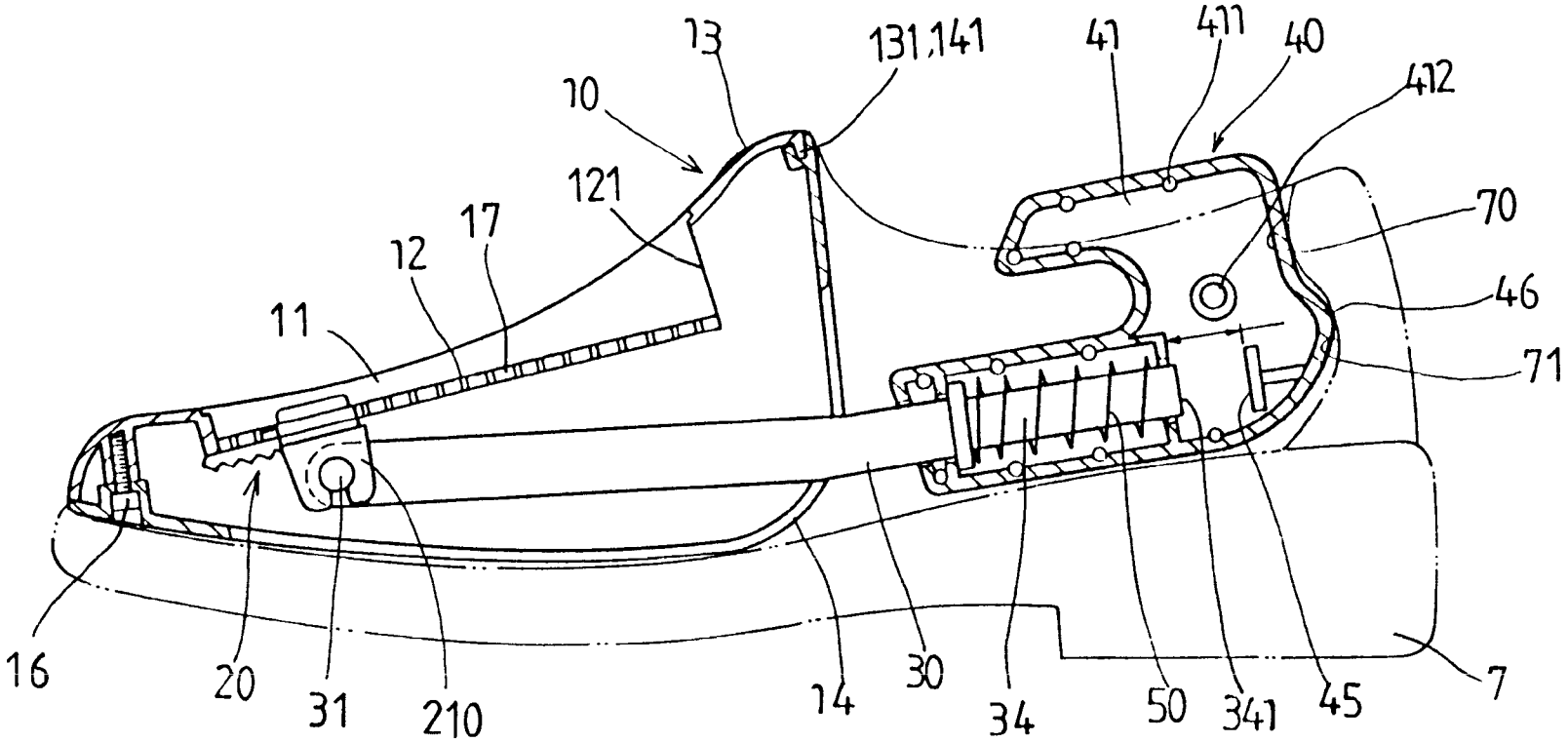

Referring to the drawings, and initially to FIGS. 1–3, a shoe tree in accordance with the present invention comprises a toe member 10 for engaging into the front portion of a shoe 7, a heel member 40 for engaging into the rear portion of the shoe 7, and a spacer bar 30 to be adjustably and resiliently secured between the toe member 10 and the heel member 40, for allowing the toe member 10 and the heel member 40 to be easily engaged into the shoe 7, and for allowing the toe member 10 and the heel member 40 to be adjustably and accurately engaged into the shoes 7 of different sizes or lengths.

As shown in FIGS. 1–10, the toe member 10 of the shoe tree includes an upper housing 13 and a lower housing 14 to be secured together. The lower housing 14 includes one or more studs or holes 142 and one or more studs 143 formed therein. The upper housing 13 includes one or more pins 132 extended downward therefrom for engaging into the holes 142 of the lower housing 14, and includes one or more studs 133 for engaging with the studs 143 of the lower housing 14. One or more fasteners 16 (FIGS. 1–3) may be engaged through the studs 133, 143 of the upper and the lower housings 13, 14 for securing the upper and the lower housings 13, 14 together. The lower housing 14 includes a lock hole 141 formed in the rear and upper portion thereof. The upper housing 13 includes a hook or a tongue 131 extended in the rear and upper portion thereof for engaging into the lock hole 141 of the lower housing 14, and for further solidly securing the upper and the lower housings 13, 14 together.

The lower housing 14 includes a passage 144 formed therein and formed or defined by a peripheral wall 147, for receiving one end, such as the front end of the spacer bar 30. The upper housing 13 includes a recess 11 formed in the upper portion thereof, and communicating with the passage 144 of the lower housing 14, and includes a pair of opposite flanges 12 extended inward of the recess 11 thereof. The flanges 12 each includes a number of teeth or depressions 17 formed therein. The upper housing 13 further includes an opening 121 formed in the upper and right portion thereof, and communicating with the recess 11 thereof.

Figure 4:
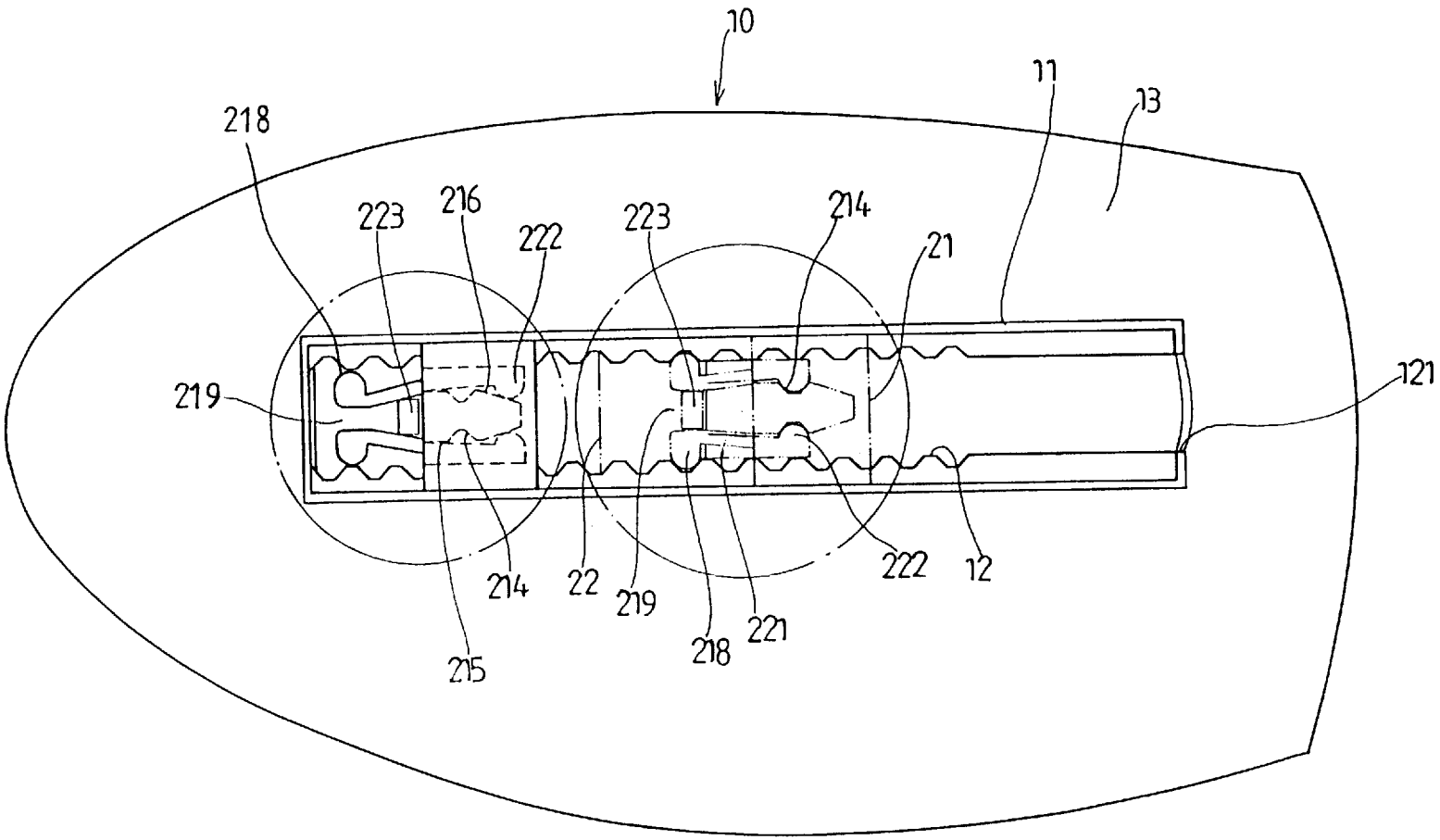
FIG. 4 is a top plan schematic view of a toe member of the shoe tree, illustrating the operation of the shoe tree.
Figure 7:
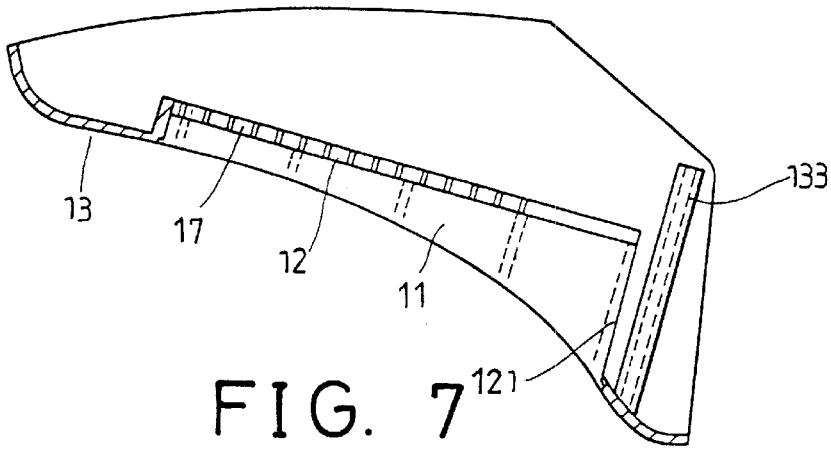
FIGS. 6, 7 are cross sectional views taken along lines 6—6 and 7—7 of FIG. 5 respectively.
Figure 5:
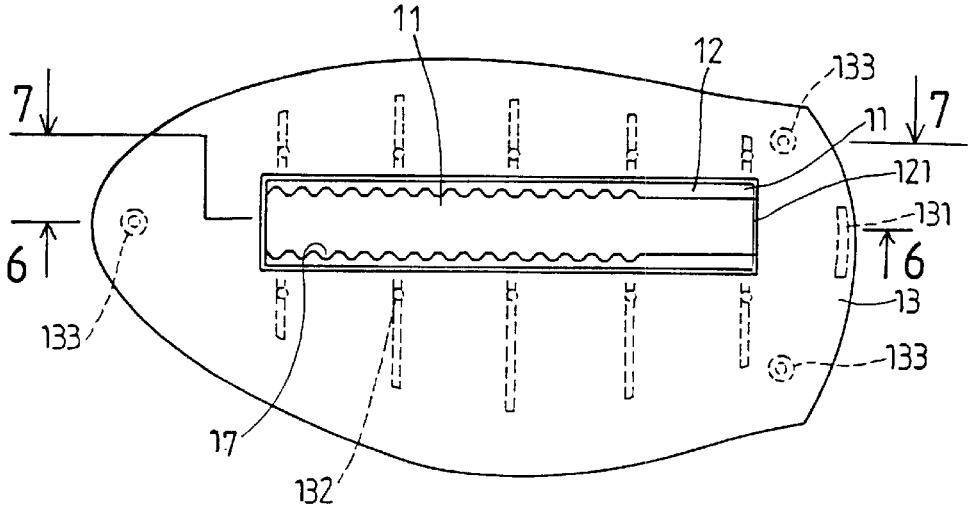
FIG. 5 is a top plan schematic view of an upper housing of the toe member.
Figure 6:
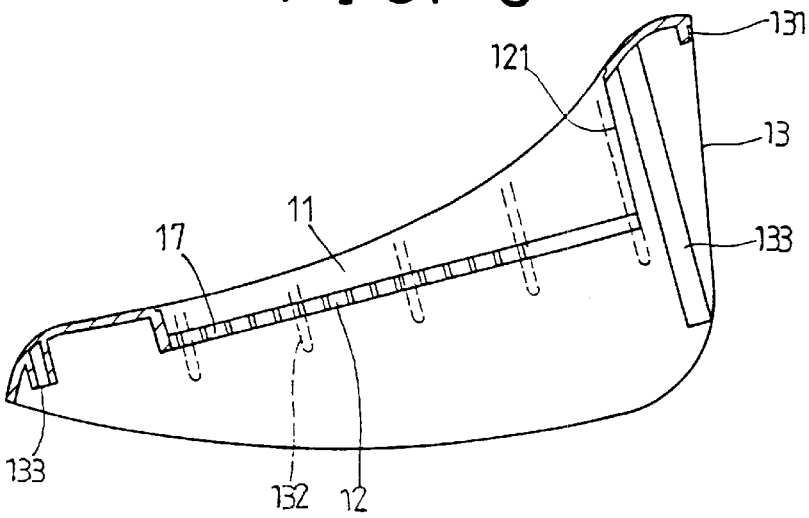
Figure 9:
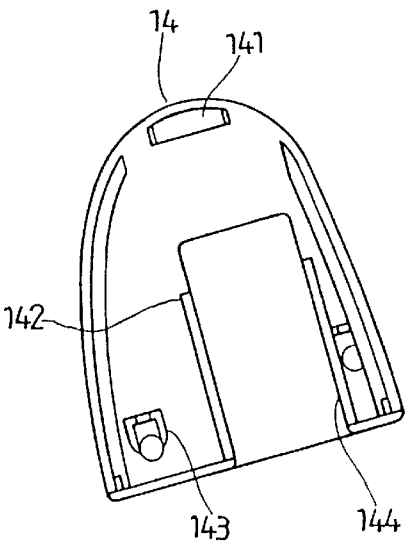
FIG. 9 is a right side schematic view of the lower housing of the toe member.
Figure 10:
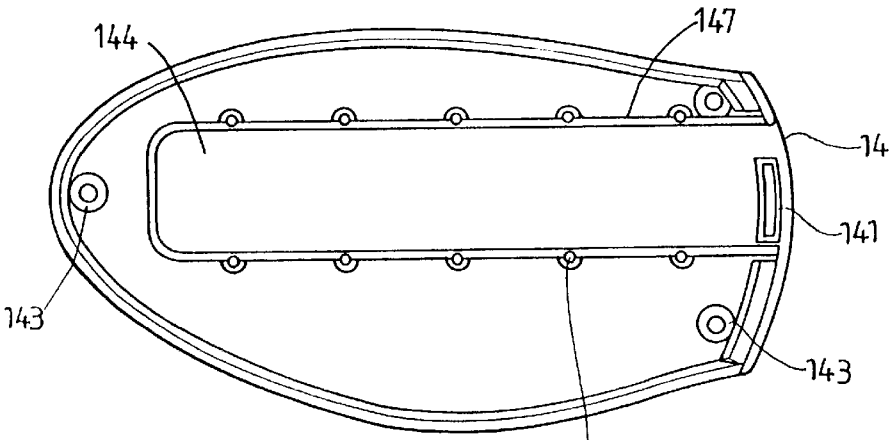
FIG. 10 is a top plan schematic view of the lower housing of the toe member.
Figure 8:
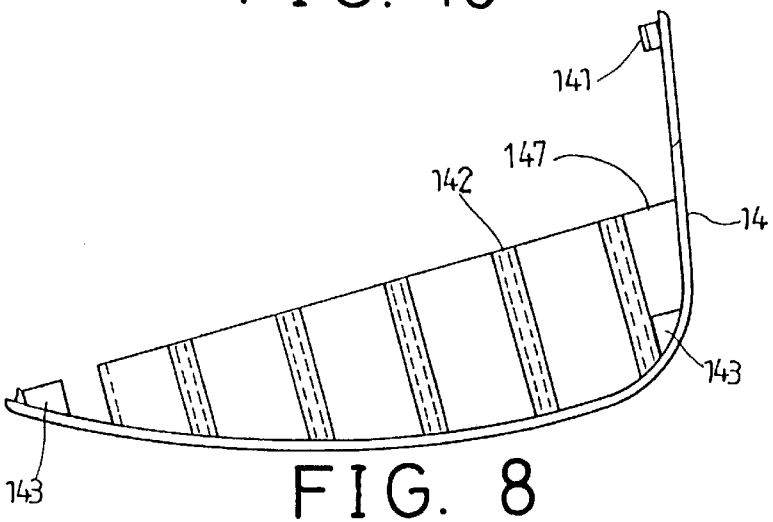
FIG. 8 is a front schematic view of a lower housing of the toe member.
Figure 14:
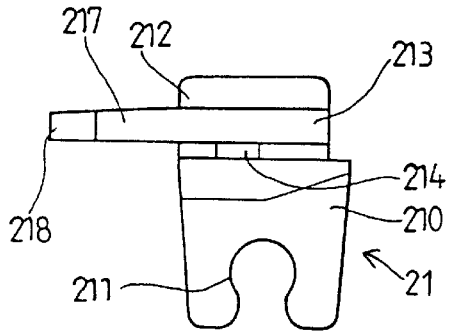
FIG. 14 is a front schematic view of the latch of the lock device.
Figure 12:
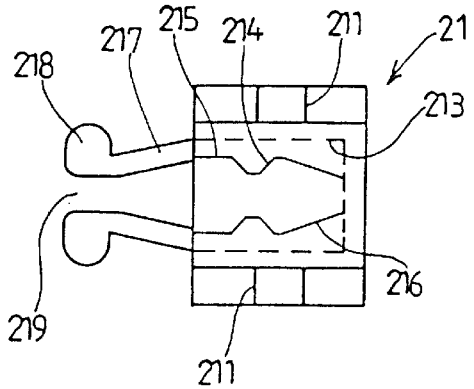
FIG. 12 is a top plan schematic view of a latch of the lock device of the shoe tree.
Figure 13:
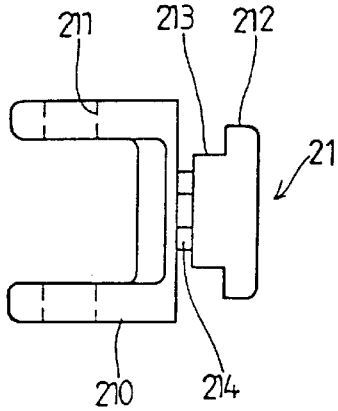
FIG. 13 is a right side schematic view of the latch of the lock device.
Figure 11:
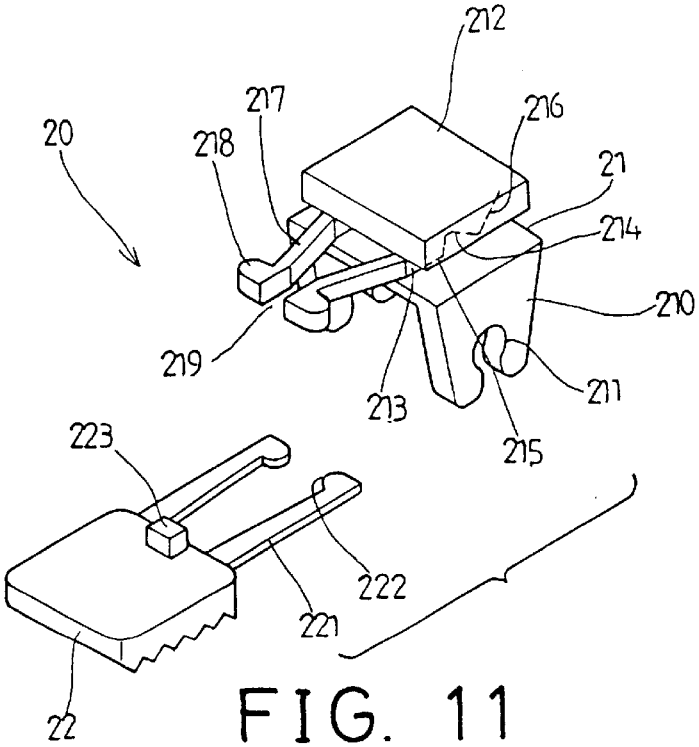
FIG. 11 is an exploded view showing a lock device of the shoe tree.
Figure 17:
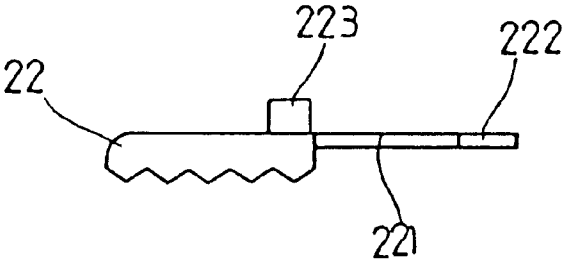
FIG. 17 is a front schematic view of the pawl of the lock device.
Figure 15:
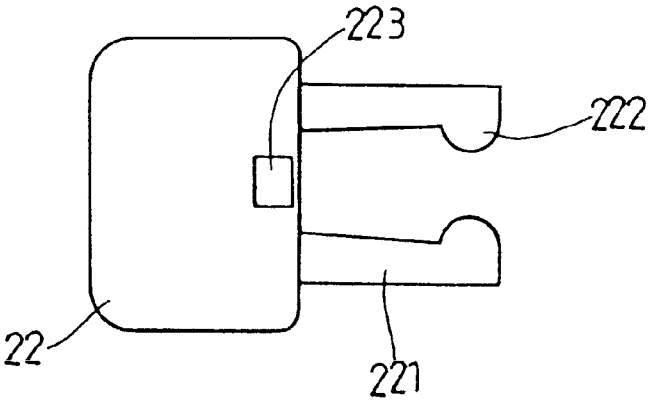
FIG. 15 is a top plan schematic view of a pawl of the lock device of the shoe tree.
Figure 16:
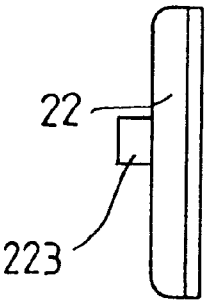
FIG. 16 is a left side schematic view of the pawl of the lock device.

Referring next to FIGS. 11–21, and again to FIGS. 1–4, a lock device 20 is provided for adjustably securing the spacer bar 30 to the toe member 10, and includes a latch 21 having one or more apertures 211 formed or provided in a base 210 thereof, for pivotally or rotatably secured to a front shaft 31 of the spacer bar 30. The latch 21 includes a pair of opposite passageways 213 formed therein and formed or defined between a block 212 and the base 210 for slidably receiving the flanges 12 of the toe member 10 and for guiding the latch 21 to move forward and rearward along the recess 11 of the upper housing 13 (FIG. 4). The latch 21 may be engaged through the opening 121 of the upper housing 13 for slidably engaging the flanges 12 into the passageways 213 of the latch 21.

As shown in FIGS. 4, 12–14, and 18–21, the latch 21 includes a pair of opposite flat surfaces 215 formed in the front portion thereof, and a pair of inclined surfaces 216 formed in the rear portion thereof, and a pair of cavities 214 formed between the flat surfaces 215 and the inclined surfaces 216 respectively, and includes a pair of arms 217 extended forward therefrom and a gap 219 formed or defined between the arms 217. The arms 217 each includes a tongue 218 for engaging with the depressions 17 of the flanges 12 respectively (FIG. 4), and for locking the latch 21 and the spacer bar 30 to the toe member 10.

As shown in FIGS. 4 and 15–21, the pawl 22 includes a protrusion 223 extended therefrom for slidably engaging in the gap 219 of the latch 21 and for forcing the tongues 218 of the arms 217 to engage with either of the depressions 17 of the flanges 12 respectively (FIG. 4), and for selectively or adjustably locking the latch 21 and the spacer bar 30 to the toe member 10. The pawl 22 includes a pair of legs 221 for slidably engaging into the passageways 213 of the latch 21 and each having a projection 222 for engaging with either of the flat surfaces 215, the cavities 214, or the inclined surfaces 216 of the latch 21 (FIGS. 4, 18, 19), and for positioning the pawl 22 and thus the protrusion 223 relative to the latch 21, and thus for maintaining the engagement or the disengaging of the tongues 218 of the arms 217 from the depressions 17 of the flanges 12 respectively (FIG. 4).

Figure 21:
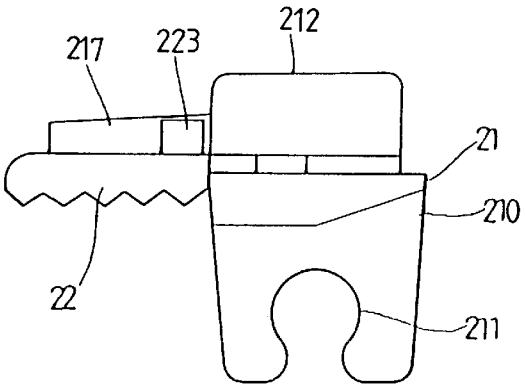
FIGS. 20, 21 are front schematic views illustrating the operation of the lock device of the shoe tree.
Figure 20:
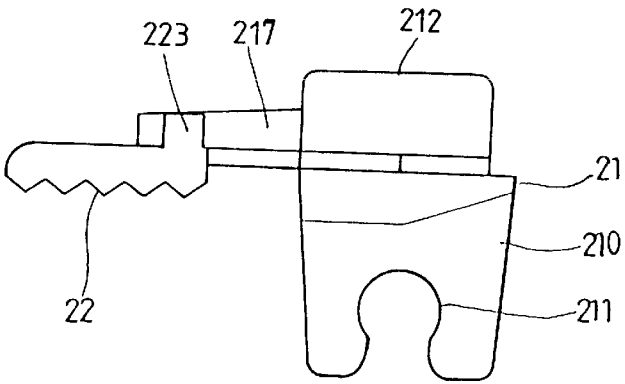
Figure 19:
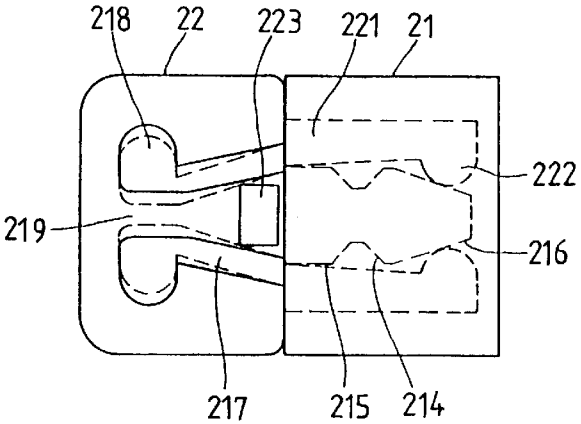
FIGS. 18, 19 are top plan schematic views illustrating the operation of the lock device of the shoe tree.
Figure 18:
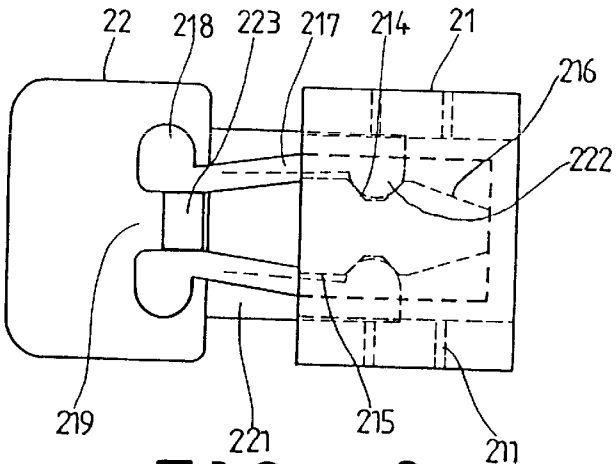
Figure 22:
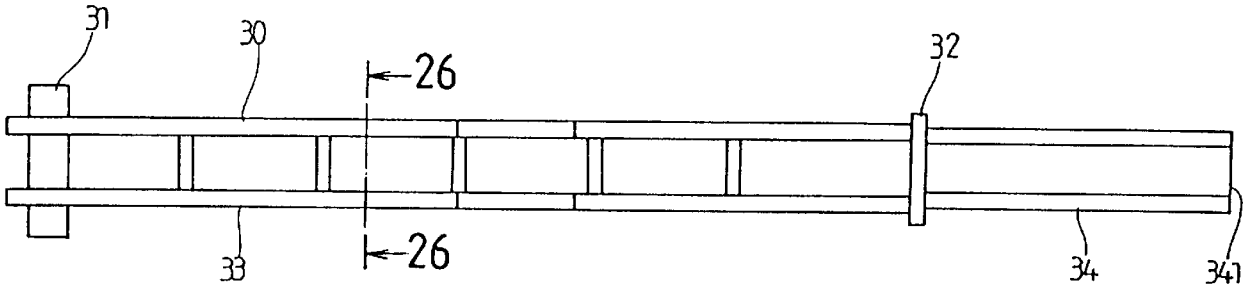
FIG. 22 is a top plan schematic view of a spacer bar of the shoe tree.
Figure 23:
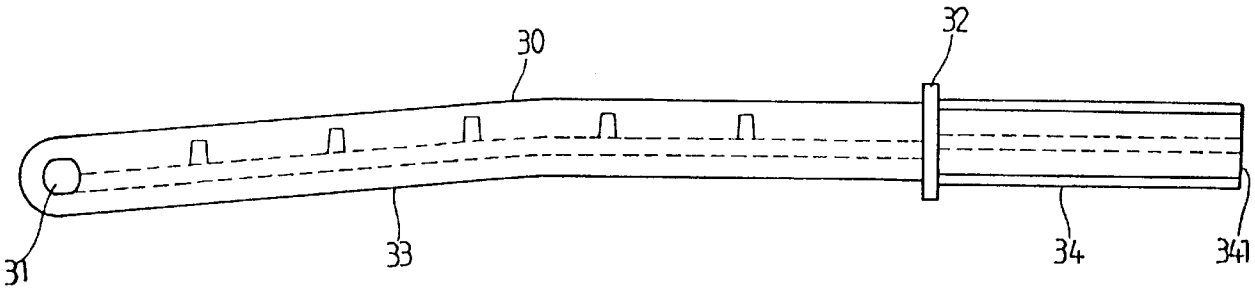
FIG. 23 is a front schematic view of the spacer bar of the shoe tree.

In operation, as shown in FIGS. 4 and 18–21, the tongues 218 of the arms 217 may be disengaged from the depressions 17 of the flanges 12 of the toe member 10 when the protrusion 223 of the pawl 22 is disengaged from the tongues 218 of the arms 217, as shown in the left portion of FIG. 4 and as shown in FIGS. 19, 21, such that the lock device 20 and thus the spacer bar 30 may be moved and adjusted relative to the toe member 10. When the protrusion 223 is slided along the gap 219 of the latch 21 to engage with and to force the tongues 218 of the arms 217 to engage with either of the depressions 17 of the flanges 12 respectively, as shown in the right portion of FIG. 4 and as shown in FIGS. 18, 20, the lock device 20 and the latch 21 and thus the spacer bar 30 may thus be selectively or adjustably locked to the toe member 10. The spacer bar 30 may thus be quickly adjusted or micro-adjusted relative to the toe member 10.

Figure 24:
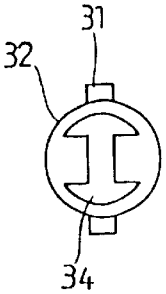
FIG. 24 is a right side schematic view of the spacer bar of the shoe tree.
Figure 25:
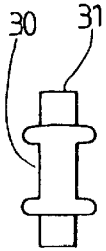
FIG. 25 is a left side schematic view of the spacer bar of the shoe tree.
Figure 26:
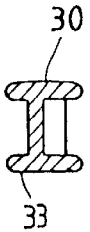
FIG. 26 is a cross sectional view taken along lines 26—26 of FIG. 22.
Figure 28:
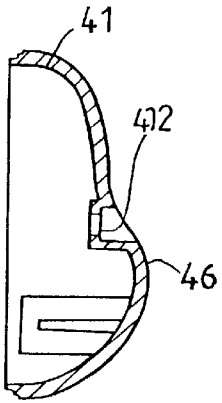
FIGS. 28, 29, 30, 31 are cross sectional views taken along lines 28—28, 29—29, 30—30, and 31—31 of FIG. 27 respectively.
Figure 29:
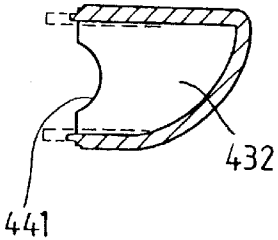
Figure 27:
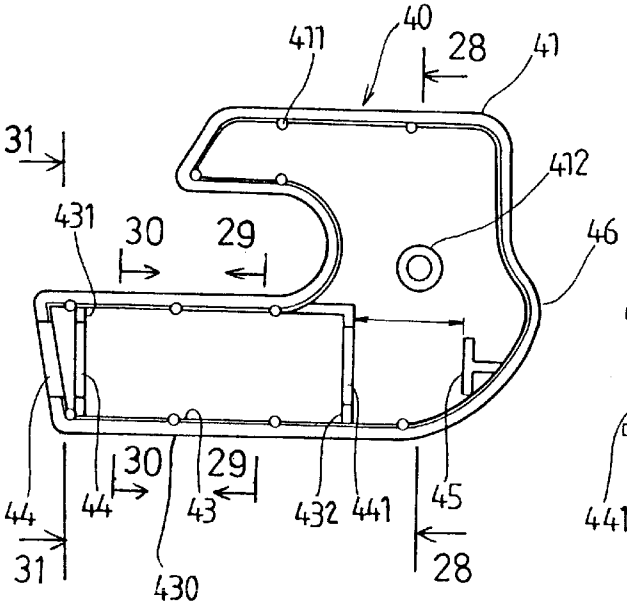
FIG. 27 is a front schematic view of one side casing of the heel member of the shoe tree.
Figure 30:
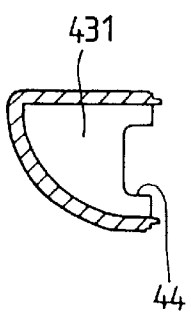
Figure 31:
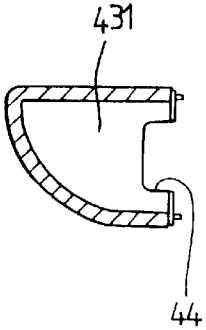

Referring next to FIGS. 22–26, and again to FIGS. 1–3, the spacer bar 30 includes the front shaft 31 for rotatably engaging into the apertures 211 of the base 210 of the latch 21, and for pivotally or rotatably coupling the spacer bar 30 to the toe member 10. The spacer bar 30 includes a middle portion 33 having a square, a rectangular or a non-circular or an H-shaped cross section, and includes a stop 32 formed or provided on the middle portion and closer to the right or rear end thereof, for example, and includes a right or rear portion 34 having a circular outer shape and/or having an I-shaped cross section (FIG. 24). The spacer bar 30 includes a right or rear end 341 for engaging with the heel member 40.

Referring next to FIGS. 27–36, and again to FIGS. 1–3, the heel member 40 includes two side casings 41, 42 each having one or more studs 412, 422 provided therein and aligned and engaged with each other. One or more fasteners (not shown) may be engaged through the studs 412, 422 for solidly securing the side casings 41, 42 together. The casing 41 includes one or more columns 411 formed or extended from the peripheral portion thereof for engaging into the peripheral holes 421 of the other casing 42 and for further solidly securing the side casings 41, 42 together. The side casings 41, 42 of the toe member 40 include a bulge 46 extended rearward therefrom for engaging into the rear recess 71 of the shoe 7 (FIGS. 2, 3) that is formed or defined by an upper swelling 70 of the shoe 7.

The heel member 40 includes a conduit 43 formed therein, such as formed in the front and lower portions of the side casings 41, 42 respectively, and formed or defined by a peripheral wall 430 and one or more front partitions 431 and one or more rear partitions 432, for slidably receiving the circular rear portion 34 of the spacer bar 30. The stop 32 of the spacer bar 30 is also slidably received in the conduit 43 of the heel member 40. The front partitions 431 each includes a square or rectangular or non-circular orifice 44 formed therein for slidably receiving the middle portion 33 of the spacer bar 30 that has the corresponding mating square or rectangular or non-circular cross section, for allowing the middle portion 33 of the spacer bar 30 to be slided in the orifices 44 of the front partitions 431 and to be prevented from rotating relative to the heel member 40. The rear partitions 432 each includes a circular orifice 441 formed therein for slidably receiving the rear portion 34 of the spacer bar 30. The heel member 40 includes a pad or an anvil 45 provided in the rear portion thereof, such as provided in each of the side casings 41, 42 of the heel member 40 for engaging with the end portion 341 of the spacer bar 34 (FIG. 2), and for limiting the sliding movement of the spacer bar 30 relative to the heel member 40.

As shown in FIGS. 1–3, a spring 50 is engaged on the rear portion 34 of the spacer bar 30 and engaged between the stop 32 of the spacer bar 30 and the rear partition 432, for biasing the spacer bar 30 toward the toe member 10, or away from the heel member 40, or away from the anvil 45 of the heel member 40, and thus for biasing the toe member 10 and the heel member 40 against the front portion and the rear portion of the shoe 7, best shown in FIG. 3.

In operation, as shown in FIGS. 1 to 4, the front portion of the spacer bar 30 may be moved and adjusted relative to the toe member 10 and may then be secured to the toe member 10 with the lock device 20, according to the size or the length of the shoe 70 to be braced. As shown in FIG. 2, the toe member 10 may then be engaged into the front portion of the shoe 7, and the heel member 40 may be pressed toward the spacer bar 30 and the toe member 10 against the spring 50, for allowing the heel member 40 to be easily engaged into the rear portion of the shoe 7. As shown in FIG. 3, when the heel member 40 has been engaged into the rear portion of the shoe 7 and when the heel member 40 is released, the spring 50 may bias the heel member 40 away from the spacer bar 30 and/or the toe member 10 for biasing and clamping the shoe tree in the shoe 7.

It is to be noted that the spacer bar 30 may be quickly or micro-adjusted relative to the toe member 10 with the lock device 20. In addition, the spring 50 may be biased between the heel member 40 and the spacer bar 30, or between the heel member 40 and the toe member 10, such that the heel member 40 may further be biased and moved relative to the spacer bar 30 for allowing the toe member 10 and the heel member 40 to be adjustably and accurately engaged into the shoes 7 of different sizes or lengths.

Figure 37:
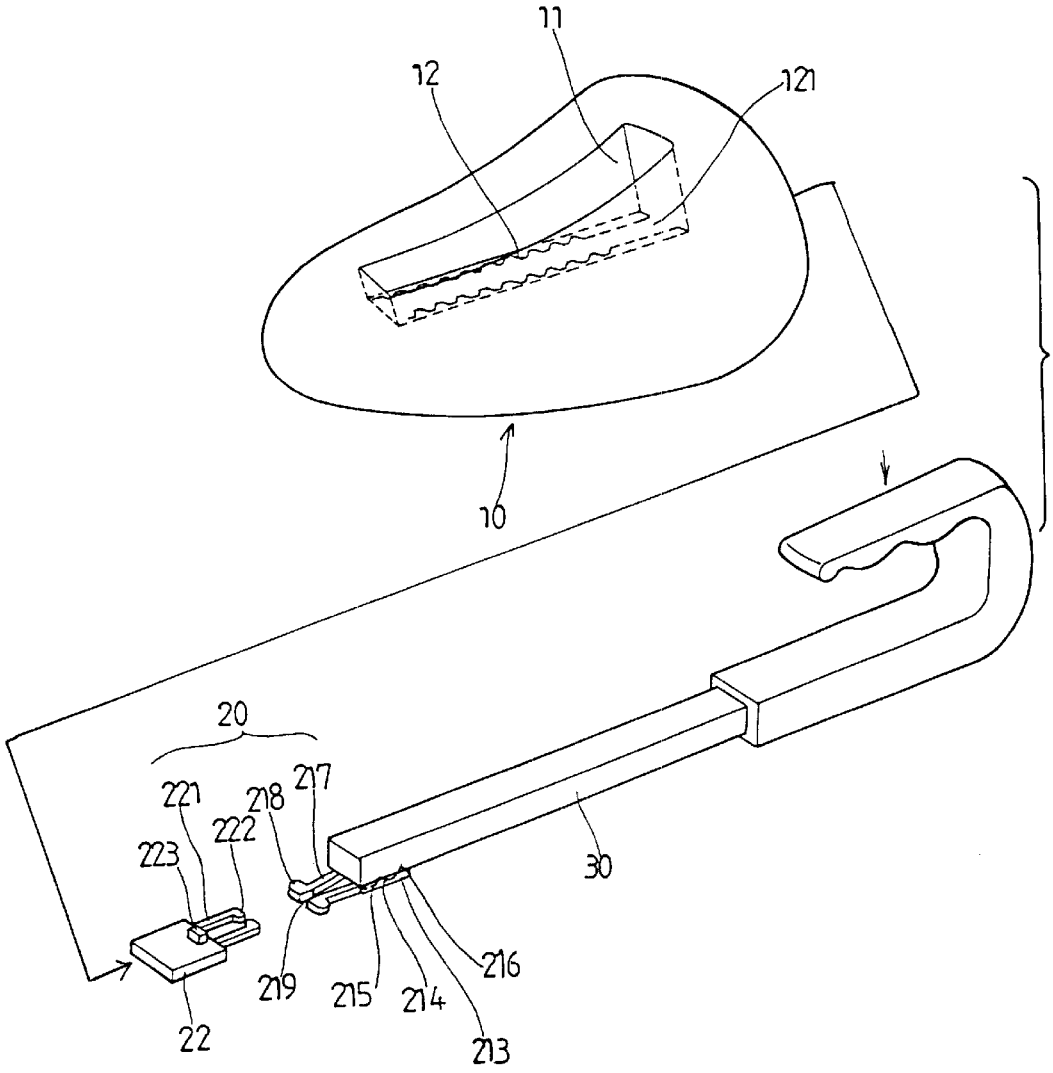
FIG. 37 is an exploded view illustrating another embodiment of the shoe tree.
Figure 38:
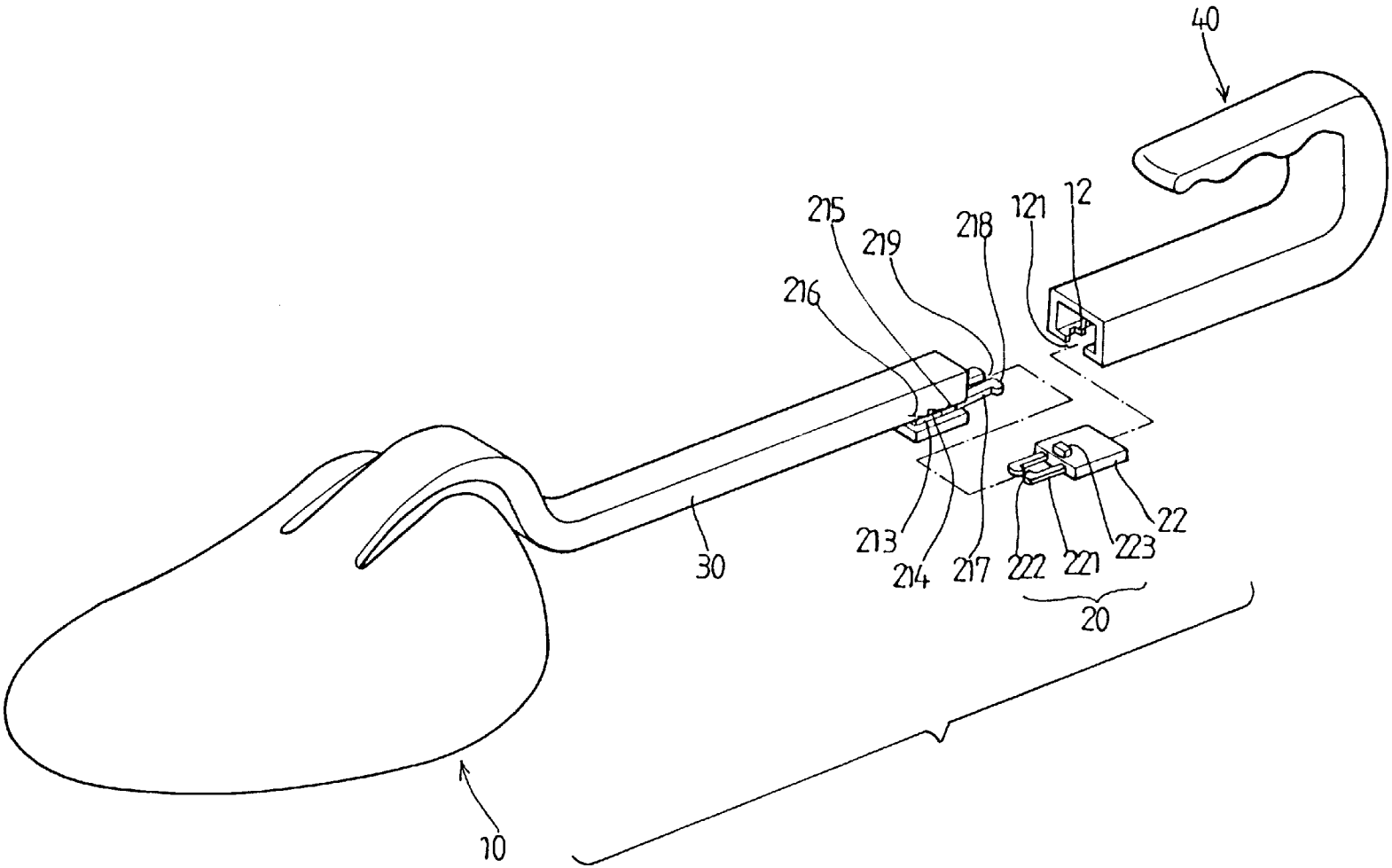
FIG. 38 is an exploded view illustrating a further embodiment of the shoe tree.
Figure 39:
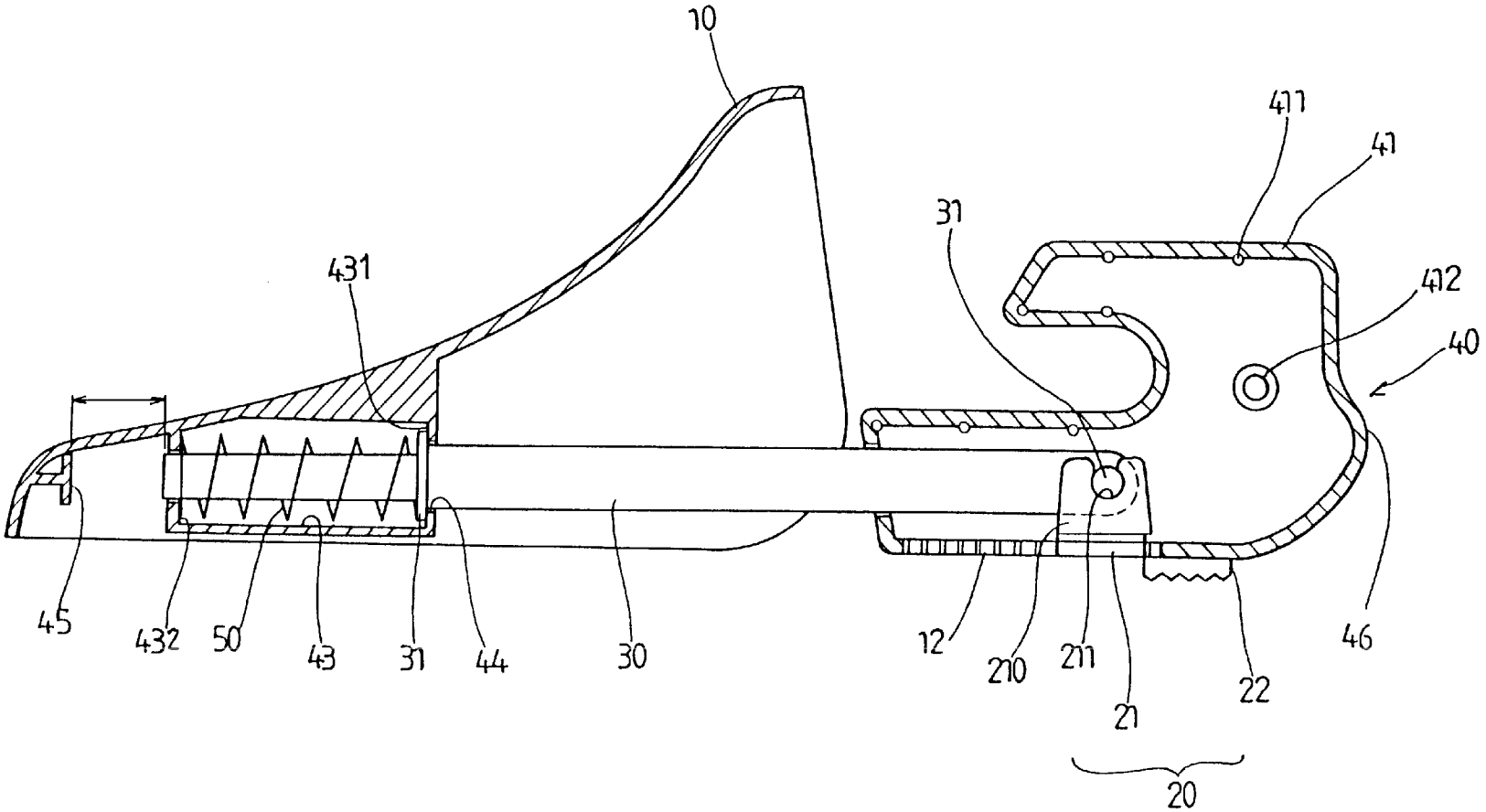
FIG. 39 is a cross sectional view illustrating a still further embodiment of the shoe tree.

Alternatively, as shown in FIGS. 37–39, the toe member 10 may be formed as an integral one-piece structure. The heel member 40 and the spacer bar 30 may also be formed as an integral one-piece structure (FIG. 37) or may be adjustably secured together with the lock device 20 (FIG. 38). The spacer bar 30 and the toe member 10 may be adjustably secured together with the lock device 20 (FIG. 37), or may also be formed as an integral one-piece structure (FIG. 38). Or, further alternatively, as shown in FIG. 39, the heel member 40 and the spacer bar 30 may be adjustably secured together with the lock device 20, and the front portion of the spacer bar 30 may be resiliently coupled to or secured to the toe member 10 with the spring 50.

Accordingly, the shoe tree in accordance with the present invention includes a micro-adjusting mechanism or structure for allowing the shoe tree to be suitably adjusted relative to various kinds of shoes that have different lengths or different inner volumes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shoe tree comprising:

a toe member for engaging with a front portion of a shoe, a heel member for engaging with a rear portion of the shoe, a spacer bar including a front portion for engaging with said toe member and a rear portion for engaging with said heel member, means for adjustably securing said front portion of said spacer bar to said toe member, said adjustably securing means including a lock device for adjustably securing said front portion of said spacer bar to said toe member, said lock device including at least one flange provided in said toe member and having a plurality of depressions formed therein, a latch secured to said front portion of said spacer bar and having at least one arm, and means for forcing said at least one arm to engage with said at least one flange of said toe member, and said forcing means including a pawl slidably secured to said latch and having a protrusion for engaging with said at least one arm and for forcing said at least one arm to engage with said at least one flange of said toe member, and means for biasing said heel member away from said spacer bar to engage with the rear portion of the shoe.

2. The shoe tree according to claim 1, wherein said heel member includes a conduit formed therein for slidably receiving said rear portion of said spacer bar, said biasing means includes a spring engaged between said spacer bar and said heel member for biasing said heel member away from said spacer bar.

3. The shoe tree according to claim 2, wherein said spacer bar includes a stop provided thereon and slidably received in said conduit of said heel member, said spring is engaged between said stop and said heel member.

4. The shoe tree according to claim 1, wherein said heel member includes an anvil provided therein for engaging with said spacer bar and for limiting a sliding movement of said spacer bar relative to said heel member.

5. The shoe tree according to claim 1, wherein said spacer bar includes a middle portion having a non-circular cross section, and includes a rear portion having a circular cross section, said heel member includes a conduit formed therein and defined by at least one first partition and at least one second partition, said at least one first partition includes a non-circular orifice formed therein for slidably receiving said non-circular middle portion of said spacer bar, and said at least one second partition includes a circular orifice formed therein for slidably receiving said circular rear portion of said spacer bar.

6. A shoe tree comprising:

a toe member for engaging with a front portion of a shoe, a heel member for engaging with a rear portion of the shoe, a spacer bar including a front portion for engaging with said toe member and a rear portion for engaging with said heel member, means for adjustably securing said front portion of said spacer bar to said toe member, said adjustably securing means including a lock device for adjustably securing said front portion of said spacer bar to said toe member, said lock device including two flanges provided in said toe member and each having a plurality of depressions formed therein, a latch secured to said front portion of said spacer bar and having two arms, and means for forcing said arms to engage with said flanges of said toe member, and means for biasing said heel member away from said spacer bar to engage with the rear portion of the shoe, said forcing means including a pawl slidably secured to said latch and having a protrusion for engaging with said arms and for forcing said arms to engage with said flanges of said toe member.

7. The shoe tree according to claim 6, wherein said arms each includes a tongue for engaging with said depressions of said flanges respectively, said pawl is movable between said tongues for forcing said tongues to engage with said depressions of said flanges respectively.

8. The shoe tree according to claim 6 further comprising means for retaining said pawl to said latch.

9. The shoe tree according to claim 8, wherein said retaining means includes at least one cavity in said latch, and at least one leg extended from said pawl and having a projection for engaging with said at least one cavity of said latch.

10. A shoe tree comprising:

a toe member for engaging with a front portion of a shoe, a heel member for engaging with a rear portion of the shoe, a spacer bar including a front portion for attaching to said toe member and a rear portion for attaching to said heel member, a latch secured to said front portion of said spacer bar and having at least one arm, and means for forcing said at least one arm to engage with said toe member and to adjustably secure said front portion of said spacer to said toe member, said forcing means including a pawl slidably secured to said latch and having a protrusion for engaging with said at least one arm and for forcing said at least one arm to engage with said at least one flange of said toe member.

11. The shoe tree according to claim 10, wherein said toe member includes two flanges each having a plurality of depressions formed therein, said at least one arm includes a tongue for engaging with said depressions of said flanges respectively, said pawl is movable relative and along said tongue for forcing said tongue to engage with said depressions of said flanges respectively.

12. The shoe tree according to claim 11, wherein said latch includes at least one cavity formed therein, said pawl includes at least one leg extended therefrom and having a projection for engaging with said at least one cavity of said latch.

* * * * *